US005160123A

United States Patent [19]

Danieli

[11] Patent Number: 5,160,123

[45] Date of Patent: Nov. 3, 1992

[54] VELOCITY-CONTROLLED RAILWAY BUFFER

[76] Inventor: Sten H. Danieli, Norra Liden 27, Gothenburg, Sweden, S-411 18

[21] Appl. No.: 635,940

[22] Filed: Dec. 28, 1990

Related U.S. Application Data

[63] Continuation-in-part of Ser. No. 466,423, filed as PCT/SE88/00476, Sep. 14, 1988, abandoned.

[30] Foreign Application Priority Data

Sep. 16, 1987 [SE] Sweden ..... 8703589

[51] Int. Cl.[5] ..... B60G 15/06

[52] U.S. Cl. ..... 267/226; 188/289; 188/284; 213/223

[58] Field of Search ..... 188/289, 284; 267/116, 267/221, 226; 213/8, 43, 223, 59

[56] References Cited

U.S. PATENT DOCUMENTS 3,215,426 10/1965 Engels ..... 188/289 X
3,367,454 2/1968 Schenk et al. ..... 188/289 X
3,456,764 7/1969 Myers ..... 188/289
3,458,054 7/1969 Thompson et al. ..... 213/43
3,554,387 1/1971 Thornhill ..... 213/223

*Primary Examiner*—Robert J. Oberleitner
*Assistant Examiner*—Lee W. Young
*Attorney, Agent, or Firm*—Lerner, David, Littenberg, Krumholz & Mentlik

[57] ABSTRACT

A buffer for railway vehicles includes a plunger telescopically received within an outer cylinder. An internal speed control valve, essentially independently of the forces acting on the buffer, causes the buffer to move inwardly at a predetermined initial velocity which is reduced by a uniform deceleration of such a level that the main portion of the plunger stroke is always used. The initial velocity corresponds to the maximum speed allowed during shunting operations, plus a safety margin determined by experience. The buffer has a leakage slot between the plunger and the cylinder to allow fluid flow around a throttling valve when the throttling valve is closed. The area of the leakage slot is dependent on the pressure within the buffer and the position of the plunger relative to the cylinder.

13 Claims, 4 Drawing Sheets

VELOCITY-CONTROLLED RAILWAY BUFFER

CROSS REFERENCE TO RELATED APPLICATIONS

The present application is continuation-in-part of application Ser. No. 07/466,423 filed as PCT/SE88/00476, Sep. 14, 1988, now abandoned.

BACKGROUND OF THE INVENTION

Railway vehicles in most countries show a similar basic design which, inter alia, includes that both ends of the vehicles are provided with a coupling device in the middle, surrounded by two buffers. The main task of the coupling device is to transfer traction forces from one vehicle to another, whilst the buffers have to take care of compressive forces or impacts between the vehicles elastically in order to reduce impact loads on structure or cargo to a harmless level.

The heaviest demands upon the function of buffers come from shunt yard operation, when railway wagons often bump together at considerable speeds. The resistance to closure of the buffers, combined with their stroke length, must be sufficient to absorb the energy of normally occuring impacts, because if a buffer reaches the end of its stroke, the system becomes rigid, and the remaining impact energy might lead to damage.

It can be mentioned that a coupling system different from the one described above, is used by several railways around the world, e.g. at the iron ore railroad between Lulea and Narvik in Northern Scandinavia. In this case, the vehicles are provided with a central draw gear in which a built-in shock absorber has the same task as the separate buffers mentioned above. The demands upon such draw gears or central couplings regarding shock absorption are, of course, the same as when separate buffers are used, and the term "buffer" in the following description is to be understood as "draw gear shock absorber" when applicable.

Due to practical reasons, it is not possible to design buffers with an extremely long stroke, and a considerable energy absorption capacity thus implies a considerable resistance to closure. If buffers are designed to take care of impacts between heavy wagons at quite high speeds, it is difficult to avoid that such buffers cause a brutal deceleration to a light wagon running into a heavy one at a moderate speed. The heavy wagon is in this case almost immovable, and the deceleration of the light one is equal to the buffer force divided by the mass of the wagon.

PRESENT STATE OF TECHNOLOGY

The kind of buffer predominant in Sweden as well as in many other countries is the ring spring buffer. It is here used in two basic models. Wagons with four axles, as well as new two axle wagons, are usually equipped with the heavier model, designed for a potential stored energy of 32 kJ, whilst a majority of two axle wagons are equipped with the weaker model having only about the half of this capacity. The ratio between resistance to closure and stroke length is almost the same in both cases, although the weaker one reaches its bottom after a shorter stroke, corresponding to a lower maximum resistance.

Ring spring buffers are generally a poor compromise, being too weak to cope with heavy wagons bumping at speeds much higher than 2 m/s, although rigid enough to give light wagons a deceleration of up to 3 g (~30 $m/s^2$) already at a bumping speed of 1.5 m/s which is the maximum value allowed in Sweden.

The Swedish State Railways have recently started testing a buffer with a hydraulic shock absorber, which gives a resistance approximately proportional to the square of the closure speed. The energy absorption thus adjusts itself to the demand, and the stroke will always be sufficient. The highest impact speed such a buffer can take care of is only limited by the hydraulic pressure which its cylinder unit can stand, and is at least twice as high as the maximum possible speed for ring spring buffers.

In relation to light wagons, however, even this hydraulic buffer is quite brutal because the resistance is dependent on the speed rather than the weight of the wagons involved. Its behavior is not mathematically well-defined, particularly because the velocity of the inward movement might vary considerably due to the different weights of the bumping wagons. Usually, different models of hydraulic buffers are preferred for 2-axle and 4-axle wagons respectively, which further complicates the matter.

Typical values of deceleration for bumping wagons, both of which are equipped with such hydraulic buffers, still tend to be high.

SUMMARY OF THE INVENTION

The invention provides a buffer which takes advantage of a specially controlled hydraulic shock absorber. It is based on the experience that the maximum bumping speed allowed, in our typical case 1.5 m/s, is often exceeded so that impact speeds in the order of 2.5 m/s are not completely rare. The buffer is made in such a way that the entire possible stroke is utilized for speeds in this order, no matter whether the involved wagons be light or heavy. This will dramatically reduce the top value of the impact deceleration in most critical cases which otherwise—with conventional buffers—cause the majority of cargo damage. The buffer is shaped as a hydraulic capsule which fits in a conventional buffer casing. The dimension of the invented buffer is based on the fact that the speed limit of 1.5 m/s in actuality is quite often exceeded. It is not realistic to reduce this speed limit because slow wagons tend to stop unintentionally, and as we cannot provide every track of all marshalling yards with an automatic retarder system, we have to accept some oversteps now and then. As a reasonable compromise, the design is based on the postulation that impacts at speeds up to 2.4 m/s are to be absorbed with a very low deceleration, whilst the buffers at heavier impacts mainly have to avoid reaching the bottom. These requirements are, of course, only valid provided that both wagons are equipped with these ideal buffers, as the invented buffer cannot influence the properties of other buffers. The deceleration at impacts between wagons with different kinds of buffers can, however, approximately be calculated as the mean value of the downright alternatives with similar buffers.

In one arrangement, the control valve is made as a flow-limiting valve possessing means to restrict the flow of hydraulic liquid in the mentioned way.

In a preferred arrangement, the mentioned flow-restricting means are made to allow a pre-determined maximum flow, which defines the maximum impact speed allowed.

In another arrangement, means are arranged to, under considerable pressure drop, shunt the flow beside the flow-limiting valve if the velocity of the inward movement of the buffer exceeds the velocity defined by said valve.

These latter means are conveniently arranged in such a way that the relation between, the shunted flow and the pressure drop depends on how far the buffer has been moved inwardly.

In a convenient arrangement, the flow restricting means are arranged to define an allowed velocity of the buffer movement, which velocity regarded as a function of the buffer travel creates a horizontal parabola, through which the movement is uniformly decelerated.

In yet another convenient arrangement, the valve system comprising control valve and flow restricting means is arranged in order not to become initially activated at impact speeds below the allowed maximum, the buffer movement thus being initially retarded only by negligible hydraulic losses, although as soon as the movement reaches the allowed buffer velocity in relation to the travel, it is forced to follow this by the valve and flow restricting means defined relation.

In a practical model, the arrangement is such that the flow control valve comprises a sleeve with an internal orifice plate, said sleeve being slidably mounted in the plunger unit and affected by a recoil spring, whereas the orifice plate has a communicating connection with an outlet aperture for the hydraulic liquid, the area of said outlet aperture being defined by the position of the sleeve, and that a metering pin is mounted coaxially with the orifice in such a way that said orifice combined with the cross sectional area of the pin determine the course of the movement.

Conveniently, a reservoir chamber for the hydraulic liquid surrounds the plunger/cylinder device, and a one-way valve is mounted between the outlet from the sleeve and the reservoir chamber.

In one arrangement, the above-mentioned means for shunting the flow of hydraulic liquid comprises a thinned cylinder wall which is expandable when exposed to high pressure.

In another embodiment the shunt principle is replaced by a plunger end position sensitive system providing an added net force to a spring loaded throttling sleeve.

If two vehicles, both equipped with buffers according to the invention, collide at the maximum speed mentioned above, the deceleration will be equally gentle independent of whether the vehicles are heavy or light.

If the impact speed should be higher than intended, the pressure of the hydraulic liquid is prevented from increasing immensely with the help of a leakage slot, the area of which depends on the pressure, by letting out the liquid flow which the flow-limiting valve refuses to release. The dependence of the slot area on the pressure is progressively reduced during the inward movement of the buffer.

This way, the function of the buffer at abnormal high impact speeds is changed to absorbing corresponding impact energy almost like previously known hydraulic buffers, although, at moderate speeds, it gives a predetermined low deceleration irrespective of the weight of the involved wagons.

As practically the entire buffer stroke is always utilized, it is clear that most of the advantages of the buffer will be realized even if the other wagon should have e.g. ring spring buffers.

The fact that almost every bump causes the same buffer travel is used for a condition indication which is unique for the invented buffer. A mechanical wiper is mounted in such a way that a clean trace along the outside of the buffer casing indicates the length of the buffer's normal travel. Any malfunction will cause a different stroke length which is easily observed at an early stage. Particularly for hydraulic buffers, whose mechanism is completely unaccessible for active-service inspection, and for which a service interval of 5–10 years is desirable for economic reasons, a simple check method for early detection of faulty shock-absorbing function is very useful.

DESCRIPTION OF THE PREFERRED EMBODIMENTS

Figure 1:
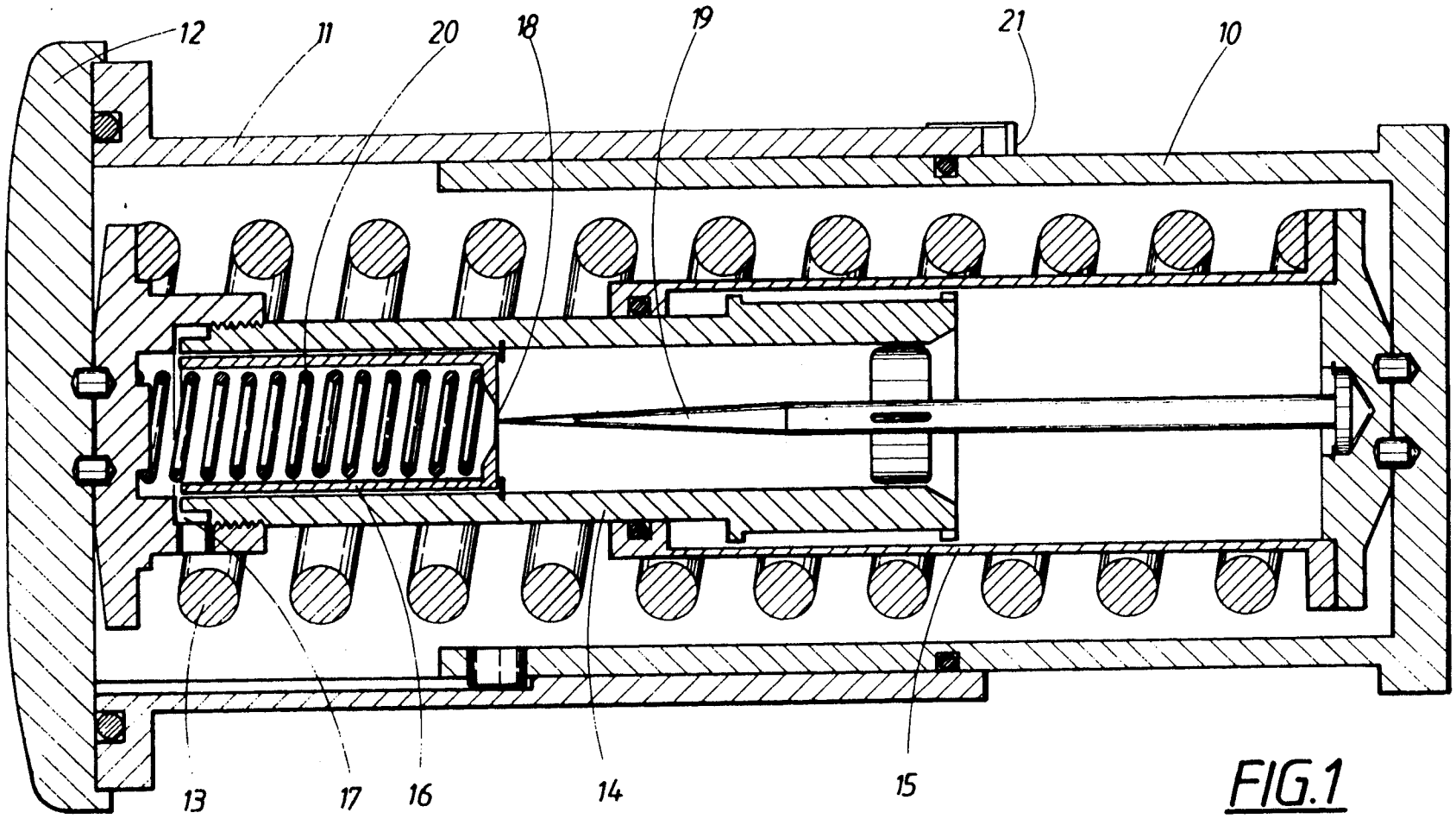
FIG. 1 shows a longitudinal cross-sectional view of a buffer according to the invention.

FIG. 1 is a longitudinal sectional view of a buffer according to the invention. The buffer casing 10 forms together with the slidable jacket 11 and the buffer head 12 a fluid-tight case, most of which is filled with hydraulic oil. A recoil spring 13 normally keeps the buffer in the extended initial position.

In the middle there is a hollow plunger 14 partially inserted in a cylinder 15. These are completely filled with hydraulic oil. When the buffer is compressed, a certain amount of the oil inside the cylinder 15 and the plunger 14 has to be displaced, which is mainly done through the annular outlet channel 17. To arrive here, the oil has to pass the orifice plate 18 in a slidable sleeve 16 which is kept in its shown neutral position by a tightened spring 20. If the movement tends to get faster than intended, the pressure drop through the orifice 18 becomes big enough to overcome the spring force, and move the sleeve 16. The sleeve will thus partially close the outlet channel 17, thereby reducing the flow to a level which creates a balance between the spring force against the sleeve 16, and the pressure drop through the orifice 18. The tension of the spring is chosen so as to make this balancing flow correspond to the allowed buffer closure velocity at the beginning of the stroke.

The metering pin 19 will reduce the area of the orifice 18 as the stroke proceeds, thus reducing the flow required to achieve the pressure drop which balances the spring. The geometry is chosen so as to bring about the desired deceleration. At the end of the stroke, the pin 19 has a cross-section corresponding to the orifice 18 which makes it almost completely choked.

When the braking is finished, the recoil spring 13 returns the buffer to its initial position, at which oil is sucked back to the cylinder 15 mainly through the bottom aperture of the outlet channel 17.

The described arrangement should theoretically cause absurd oil pressures if two wagons should impact at a higher speed than permitted by the flow control valves of the buffers. Therefore, the cylinder 15 has to be provided with some kind of safety valve. In order to obtain a characteristic suitable for the buffer function, its pressure drop should depend on the degree of overspeed, and also on how far the stroke has proceeded.

In the preferred arrangement shown, the cylinder 15 is made with a principally constant bore diameter, but somewhat varying outside diameter, thus making it thicker near the end wall. The plunger 14 has no sealing rings but forms a short sliding fit in the cylinder. An increased oil pressure will expand the cylinder and thus increase the leakage slot around the plunger. Near the end of the stroke, the cylinder becomes more rigid, and here the leakage caused by a given pressure will be considerably lower.

In the figure, a wiper 21 is indicated on the buffer jacket 11. If the buffer function is correct, it scrapes a clean trace from the shown position to a point a couple of centimeters from the flange of the casing. If the trace becomes apparently shorter or longer, the buffer is out of order and requires service.

Figure 2:
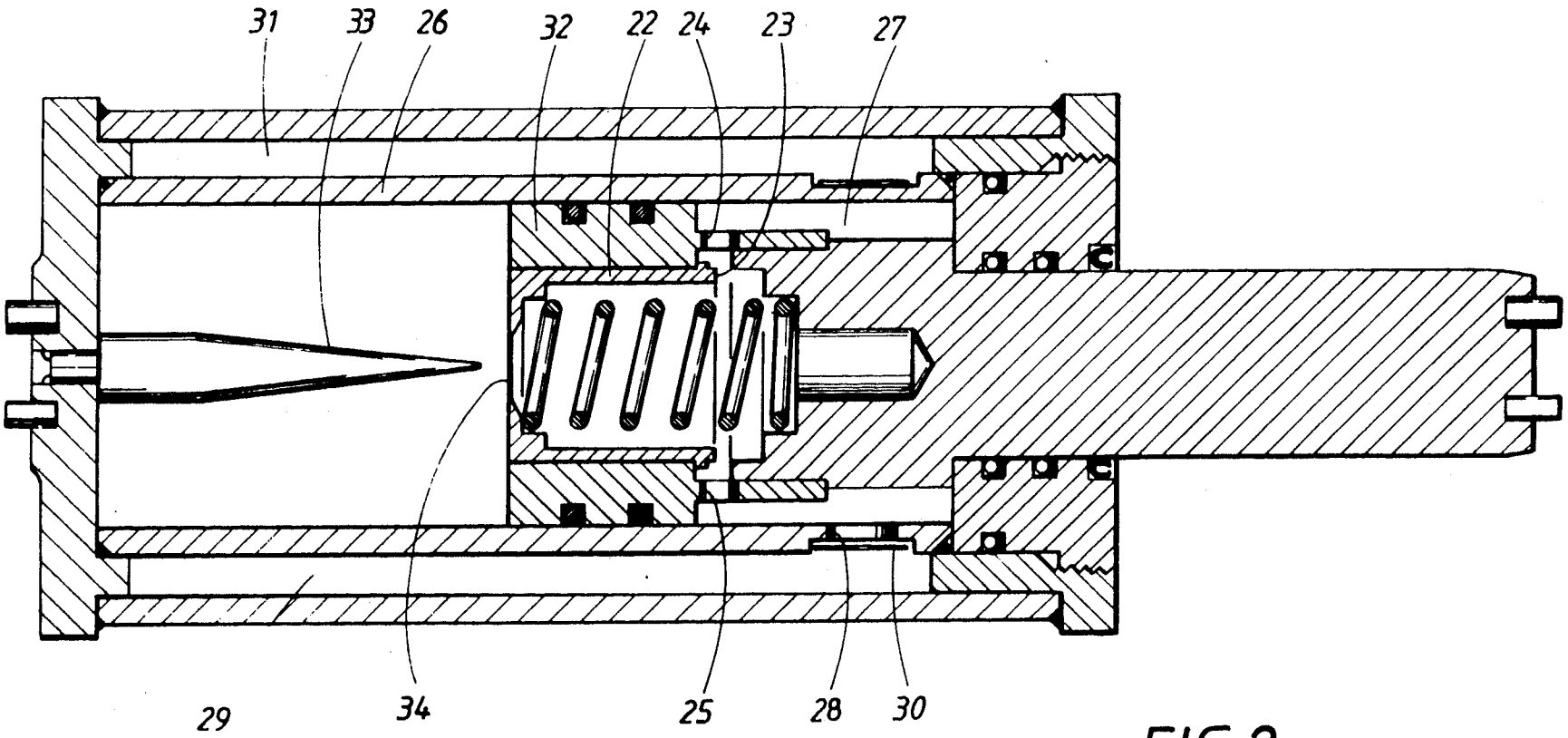
FIG. 2 shows a longitudinal cross-sectional view where the shock absorber according to the invention is made as a complete capsule to be mounted in a conventional buffer casing.

In the embodiment according to FIG. 2 a flow control valve is provided, comprising a spring-loaded sleeve 22 which initially accepts an oil flow corresponding to 1.2 m/s (i.e. half the bump speed 2.4 m/s). Should the velocity tend to grow higher, the pressure drop along the sleeve 22 will overcome the spring force. The sleeve will then move until its rear end 23 chokes the radial outlet, thus maintaining the correct flow to balance the pressure drop against the spring force.

The radial outlet channel leads through boreholes 24, 25 to an annular chamber 27 inside the cylinder 26. The chamber 27 is communicating with a hydraulic reservoir chamber 29 through a hole provided with a one-way valve 30. An over-pressure is kept in the reservoir chamber 29, a part of which 31 being gas-filled.

Figure 3:
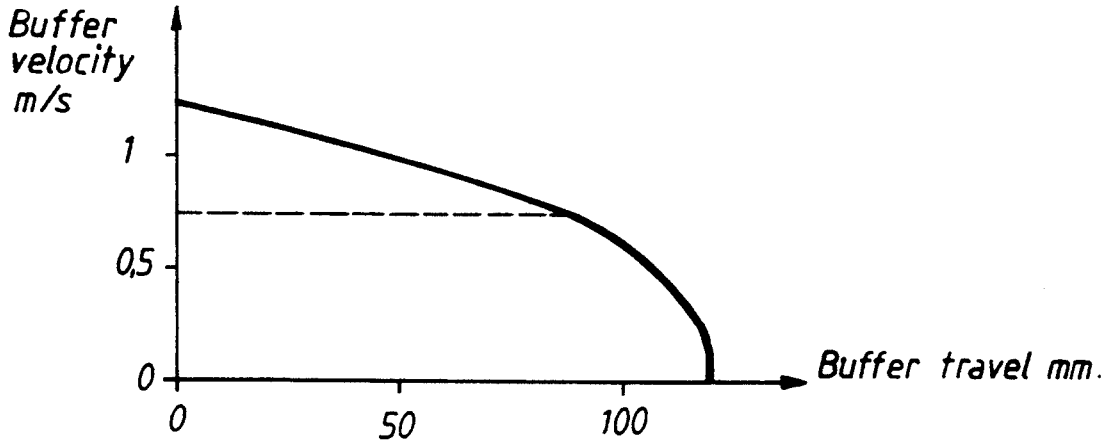
FIG. 3 shows the forced flow-restricting action of the flow-control valve in terms of closing velocity of a buffer in relation to the stroke.
Figure 4:
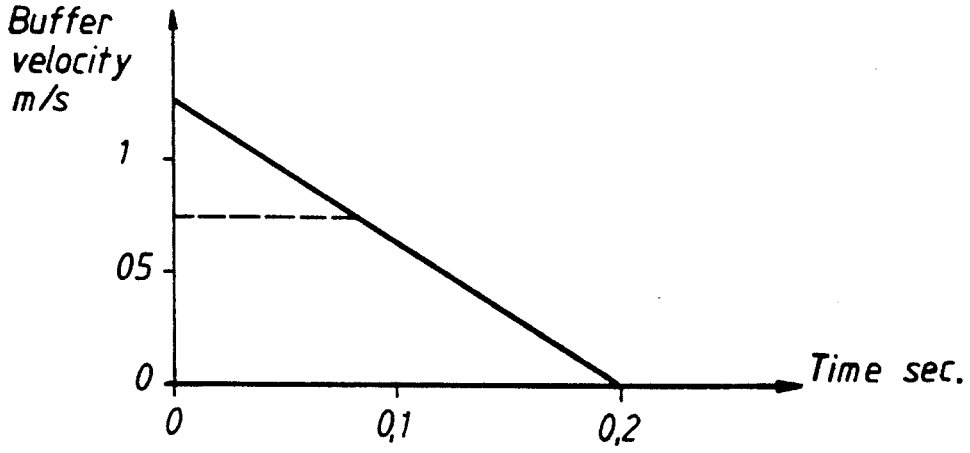
FIG. 4 shows the closing velocity as a function of the time for a flow characteristic according to FIG. 3.

The more the buffer plunger 32 is moved inwardly, the more the area of the sleeve's orifice is reduced by a metering pin 33, and the allowed velocity decreases. The metering pin 33 is shaped in such a way that the allowed velocity as a function of the stroke forms a horizontal parabola, as shown in FIG. 3. The speed as a function of the time thus forms a straight line, i.e. the deceleration is constant, and with adequate dimensions e.g. always=0.6 g, which is satisfactorily low. The deceleration pattern appears in FIG. 4.

If the impact speed is lower than 2.4 m/s (1.2 m/s per buffer) only a slight deceleration takes place initially, due to hydraulic losses and the like, until the plunger velocity (dotted line in FIGS. 3 and 4) hits the control curve (continuous line), at which moment the controlled deceleration starts. The fact that the deceleration of the buffer movement is always limited to e.g. 0.6 g means in the worst impact case (a light wagon hitting a heavy, immovable one) that the deceleration of the light wagon cannot exceed 1.2 g (=0.6 g per buffer). Higher deceleration cannot theoretically occur unless impact speed exceeds 2.4 m/s.

If it does, the flow control valve tries to close the outlet completely, but the end rim of the sleeve has such a shape that the valve in such case starts acting as a safety valve. The buffer then gets a characteristic similar to that of the earlier mentioned conventional hydraulic buffers, i.e. it absorbs the impact without exceeding the normal stroke, causing a deceleration rather equivalent to ring spring buffers.

FIG. 2 thus shows the fundamental design of the complete hydraulic buffer capsule. The chamber 29 between the cylinder tube and the outer casing forms an oil reservoir, and ensures the proper function even if some decilitre of oil should leak out over the years. The reservoir 29 is half-filled with nitrogen to a pressure of about 50 bar which gives the permanent recoil force the buffer must maintain.

The connection between the cylinder and the reservoir is situated at the bottom and is provided with a one-way choking valve 30. The purpose is to slow down the return movement to prevent the wagons from bouncing apart after the impact, and also to avoid that gas bubbles which might have been flushed out during the quick damping movement be sucked back. This makes the cylinder self-degassing.

Figure 5:
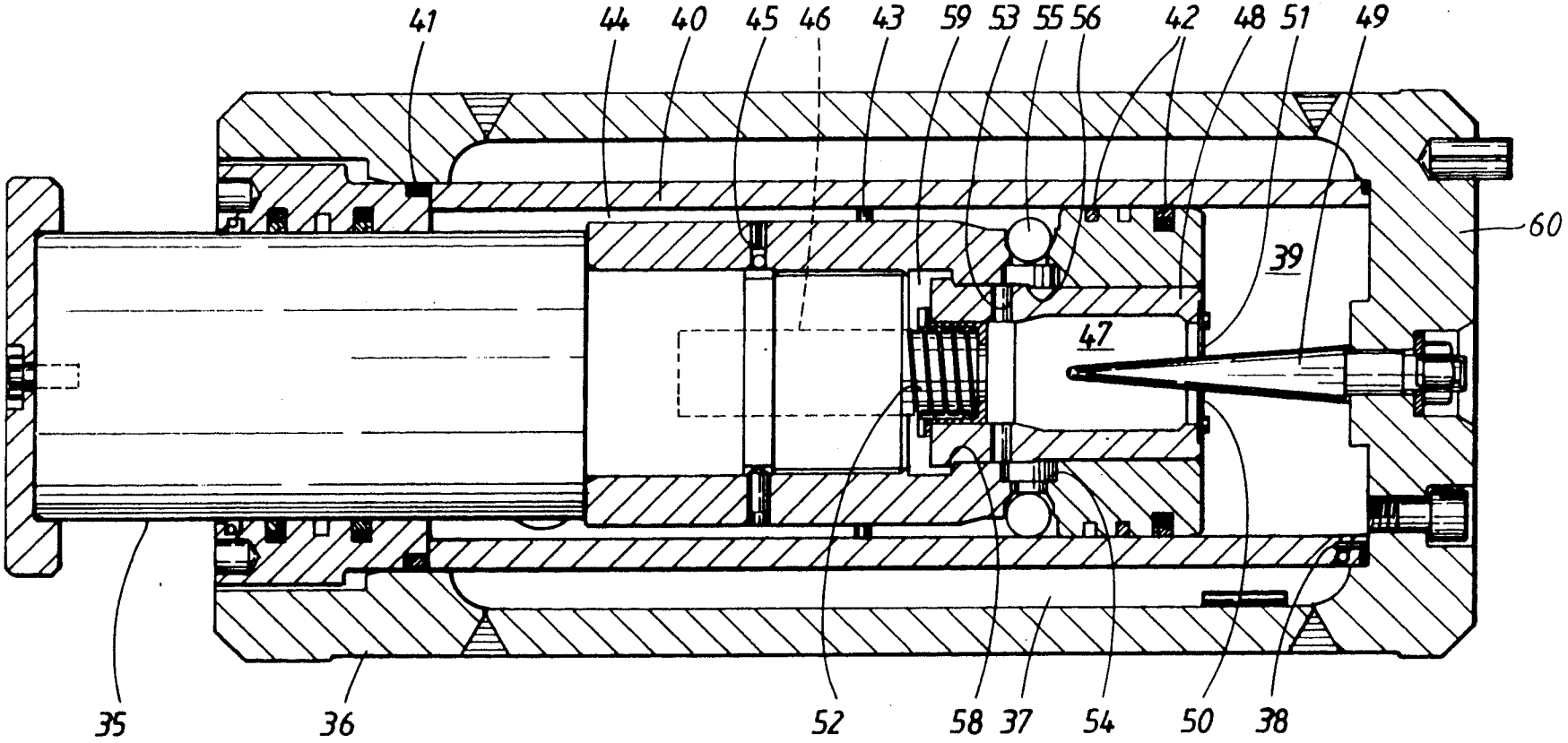
FIG. 5 shows a longitudinal cross-sectional view of a buffer having an arrangement for providing an additive spring force as soon as the design impact conditions are exceeded.

In FIG. 5 there is shown a buffer having an arrangement for providing a differential pressure created in addition to the spring force acting on the sleeve of the flow control valve as soon as a maximum impact created pressure is exceeded. The flow control valve provides a predetermined pattern of movement for the buffer provided the pressure of the hydraulic medium inside the sleeve of the control valve is lower than a predetermined valve, corresponding to allowed impact speeds, exactly as in the embodiments in FIGS. 1 and 2. However, instead of having separate arrangements for taking care of disallowed overpressure, the embodiment in FIG. 5 has a sleeve integral feature providing a basically constant attenuation or damping pressure for a built-in percentage of excess of speed relative to the maximum allowable.

In order to explain more in detail the function of the sleeve integral feature, reference is made to FIG. 5.

As in the previous embodiments there is a buffer plunger 35 and a cylinder 36. A hydraulic medium supply chamber 37 communicates through bores 38 with the working chamber 39 of the hydraulic medium. A cylindrical wall 40 forms the engagement surface of the plunger 35. At one end of the wall 40 and the lower end of the plunger 35 there are seals 41, 42. In between the seals there is a guide bushing 43 having through-flow passages. There is formed a cylindrical chamber 44 acting as a return path for the hydraulic medium. Bores 45, 46 communicate with the interior region 47 of a sleeve 48 having the same fluid restricting and throttling function as in the previous embodiments.

A restriction pin 49 is attached to the end wall 60 and extends into an opening 51 in an orifice plate 50. The design of the pin and opening plus the spring force from a biasing spring 52 determines the throttling of the hydraulic medium through openings 53 into a circumferential fluid receiving chamber 54 communicating with the cylindrical chamber 44 via check-valves 55.

The throttling action or flow of the hydraulic medium through the openings 53 defines the displacement pattern of the buffer, under the control of the pin 49 and the opening 51, exactly as previously.

However, the sleeve 48 has a shoulder 56 formed by an enlarged spring abutting end 57 of the sleeve. The enlarged end 57 has also a stop shoulder 58 limiting the sleeve movement relative to the plunger 35. The shoulder 56 is a pressure differential shoulder which is locked inside the circumferential chamber 54.

As long as the openings 53 communicate with the chamber 54, which corresponds to the normal operation mode, the pressure inside the chamber 54 equals the pressure in the rest of the working chamber and the chambers and other spaces in fluid communication.

However, if an impact condition worse than the designed one comes up, the pressure of the hydraulic medium tries to displace the sleeve opening past the circumferential chamber 54. However, as soon as the communication is cut off, a differential pressure difference is built up between the higher pressure in the working chamber 39, the intermediate chamber 59 facing the enlarged sleeve end, and the circumferential chamber 54 now closed off from the rest of the hydraulic system.

When the passages 53 are cut off, end collar 58 is freed from abutment so that the higher pressure in the intermediate chamber 59 acts on both sides of the collar, producing no net force on sleeve 48. Again, the diameter or cross-sectional area of the sleeve end 57 is larger than that of the orifice pin end of the sleeve by an amount equal to the radial area of the shoulder 56. Since the hydraulic pressure in circumferential chamber 54 is lower than the hydraulic pressure in intermediate chamber 59, the force acting on this incremental cross-section is greater on the enlarged end 57 of the sleeve than on the shoulder 56, thereby producing a net force which is added to the spring force of the biasing spring 52.

The radial area of the shoulder 56 defines how high the net force will be.

The shoulder area, thus, is the main design feature to consider, i.e. the higher the shoulder is, the larger the net force. Expressed in other words, if a higher degree of excess impact speed is expected, the larger shoulder is necessary.

We claim:

1. A hydraulic buffer, comprising a housing, a plunger slidably disposed in said housing and moveable at a movement speed relative to said housing, said plunger dividing said housing into two chambers, each of said chambers adapted to contain a fluid, passage means for defining a first fluid flow path between said chambers, throttle means for throttling the flow of said fluid through said passage means, shunt means for defining a second fluid flow path between said chambers so that there is a relationship between fluid flow rate through said second fluid flow path and pressure difference between said chambers and so that said relationship varies dependent upon the position of said plunger with respect to said housing.

2. The buffer as claimed in claim 1, wherein said throttle means includes pressure sensitive means for varying the throttling action of said throttle means in response to a pressure differential between said two chambers.

3. The buffer as claimed in claim 2, wherein said pressure sensitive means includes a body moveably disposed in said passage means and defining an aperture for permitting said fluid to flow from one of said chambers to the other one of said chambers through said passage means.

4. The buffer as claimed in claim 3, further comprising control means cooperating with said aperture for controlling the flow of said fluid through said pressure sensitive means.

5. The buffer as claimed in claim 4, wherein said control means defines a predetermined velocity pattern for said movement speed, said predetermined velocity pattern defining a horizontal parabola relative to the position of said plunger with respect to said housing for uniformly decelerating said movement speed.

6. The buffer as claimed in claim 4, wherein said control means includes a tapered pin fixedly connected to said housing and receivable in said aperture so that there is a relationship between fluid flow rate through said pressure sensitive means and the position of said plunger with respect to said housing.

7. The buffer as claimed in claim 1, wherein said shunt means includes a member adapted to occlude said second fluid flow path up to an opening pressure so that there is no fluid flow through said second fluid flow path below said opening pressure and so that said opening pressure varies dependent upon the position of said plunger with respect to said housing.

8. The buffer as claimed in claim 1, wherein said shunt means includes an elongated member having a degree of rigidity at one position in an elongation direction which is different than a degree of rigidity at another position in said elongation direction different than said one position.

9. The buffer as claimed in claim 1, further comprising a reservoir for said fluid disposed around said housing, and one-way valve means disposed between said passage means and said reservoir for restricting the flow of said fluid from said reservoir to said chambers.

10. The buffer as claimed in claim 1, further comprising indicating means slidably disposed on said housing so that movement of said plunger by a predetermined distance relative to said housing displaces said indicating means by said predetermined distance.

11. A hydraulic buffer, comprising a housing, a plunger slidably disposed in said housing and moveable at a movement speed relative to said housing, said plunger dividing said housing into two chambers, each of said chambers adapted to contain a fluid, passage means for defining a first fluid flow path between said two chambers, said passage means having an inlet passage in fluid communication with one of said chambers and an outlet passage in fluid communication with the other one of said chambers, said outlet passage including an ancillary fluid chamber, throttle means for throttling the flow of said fluid through said passage means and including pressure sensitive means disposed in said passage means for restricting the flow of said fluid through said outlet passage, said pressure sensitive means including a body disposed in said plunger and moveable between a first position permitting fluid flow through said outlet passage and a second position preventing fluid flow through said outlet passage, said body having a first end facing said one of said chambers and a second end opposite said first end, said second end having a larger cross-sectional area than said first end to define on said body a shoulder disposed in said ancillary fluid chamber, fluid pressure in said ancillary fluid chamber exerting on said shoulder an ancillary hydraulic force which varies with the position of said body with respect to said plunger, fluid pressure in said one of said chambers exerting on said first end of said body a first hydraulic force varying as a function of said movement speed of said plunger relative to said housing, an intermediate fluid chamber in fluid communication with said second end of said body, fluid pressure in said intermediate fluid chamber exerting on said second end of said body a second hydraulic force, whereby the combination of said hydraulic forces exert on said body a net force which varies dependent upon said fluid pressure in said ancillary fluid chamber.

12. The buffer as claimed in claim 11, wherein said throttle means further includes resilient means adapted to exert on said second end of said body a predetermined force opposing said first hydraulic force, whereby the combination of said predetermined force and said hydraulic forces exert on said body a combined force which varies dependent upon said fluid pressure in said ancillary fluid chamber.

13. The buffer as claimed in claim 11, wherein a periphery of said body includes a radially extending passageway adapted to be in fluid communication with said ancillary fluid chamber in said first position of said body, and adapted to be occluded by said plunger in said second position of said body.

* * * * *

UNITED STATES PATENT AND TRADEMARK OFFICE

CERTIFICATE OF CORRECTION

PATENT NO. : 5,160,123

DATED : November 3, 1992

INVENTOR(S) : Danieli

It is certified that error appears in the above-indentified patent and that said Letters Patent is hereby corrected as shown below:

Column 6, line 25, "valve" should read --value--.

Column 7, line 29, "higher" should read --larger--.

Column 7, line 29, "larger" should read --higher--.

Column 7, line 31, "the" should read --a--.

Column 8, line 41, delete "first".

Signed and Sealed this

Twelfth Day of October, 1993

*Attest:*

*Attesting Officer*

Bruce Lehman

BRUCE LEHMAN

*Commissioner of Patents and Trademarks*